US009624728B2

(12) United States Patent
Crowley et al.

(10) Patent No.: US 9,624,728 B2
(45) Date of Patent: Apr. 18, 2017

(54) CONTROLLABLE DEFLECTION HOUSING, DOWNHOLE STEERING ASSEMBLY AND METHOD OF USE

(71) Applicant: Smart Stabilizer Systems Limited, Ashchurch, Tewkesbury (GB)

(72) Inventors: Daniel Brendan Crowley, Tewkesbury (GB); Colin Walker, Derbyshire (GB)

(73) Assignee: Smart Stabilizer Systems Limited, Tewkesbury (GB)

( * ) Notice: Subject to any disclaimer, the term of this patent is extended or adjusted under 35 U.S.C. 154(b) by 754 days.

(21) Appl. No.: 13/799,755

(22) Filed: Mar. 13, 2013

(65) Prior Publication Data

US 2013/0240268 A1 Sep. 19, 2013

(30) Foreign Application Priority Data

Mar. 13, 2012 (GB) ..... 1204386.5

(51) Int. Cl.
*E21B 7/06* (2006.01)

(52) U.S. Cl.
CPC ..... *E21B 7/068* (2013.01)

(58) Field of Classification Search
CPC . E21B 4/02; E21B 4/006; E21B 7/068; E21B 7/06; F02B 13/02; F03B 3/18; F03B 3/183
See application file for complete search history.

(56) References Cited

U.S. PATENT DOCUMENTS 5,163,521 A * 11/1992 Pustanyk ..... E21B 7/04 175/107
5,220,963 A * 6/1993 Patton ..... E21B 7/04 175/24
5,535,835 A 7/1996 Walker
5,738,178 A * 4/1998 Williams et al. ..... 175/61
8,807,245 B2 * 8/2014 Scott et al. ..... 175/107
2003/0031567 A1 2/2003 Hunter et al.
2003/0056990 A1 * 3/2003 Oglesby ..... 175/57
2007/0151767 A1 * 7/2007 Downton ..... 175/73
2008/0060846 A1 * 3/2008 Belcher et al. ..... 175/25
2011/0120725 A1 * 5/2011 Downton et al. ..... 166/373

FOREIGN PATENT DOCUMENTS

GB 2363429 12/2001
GB 2394740 5/2004
WO 2008/037070 4/2008

OTHER PUBLICATIONS

Search Report received in GB Application No. GB1304099.3 dated Jun. 24, 2013, 1 page.

* cited by examiner

*Primary Examiner* — Kipp Wallace
(74) *Attorney, Agent, or Firm* — Blank Rome LLP

(57) ABSTRACT

This invention relates to a controllable deflection tool. The controllable deflection tool is likely to have its greatest utility as part of a downhole assembly to steer a drill bit during drilling for oil and gas. There is provided a controllable deflection tool having a first end and a second end, the tool having: a conduit for a working fluid; a rotary element adapted for rotation within the tool; a deflection member; a vane motor configured to rotate the deflection member relative to the rotary element; and a valve for controlling the flow of working fluid to the vane motor. There is also provided a downhole steering assembly and a method of steering a downhole drilling assembly incorporating the controllable deflection tool.

11 Claims, 3 Drawing Sheets

CONTROLLABLE DEFLECTION HOUSING, DOWNHOLE STEERING ASSEMBLY AND METHOD OF USE

CROSS-REFERENCE TO RELATED APPLICATIONS

This application claims priority to United Kingdom Patent Application No. GB1204386.5 filed on Mar. 13, 2012, the contents of which are incorporated herein by reference.

FIELD OF THE INVENTION

This invention relates to a controllable deflection tool, a downhole steering assembly, and a method of use. The controllable deflection tool is likely to have its greatest utility as part of a downhole assembly to steer a drill bit during drilling for oil and gas, and the following description therefore refers primarily to such applications. The use of the controllable deflection housing in other applications is not thereby excluded.

BACKGROUND OF THE INVENTION

When drilling for oil and gas it is desirable to be able to steer the drill bit, i.e. to move the drill bit along a chosen path, so that the drill bit does not have to follow a path determined only by gravity and/or the drilling conditions.

One method for steering a drill bit is to utilise a steering component such as that described in our published European patent 1 024 245. That steering component allows the drill bit to be moved in any chosen direction, i.e. the direction (and degree) of curvature of the borehole can be determined during the drilling operation, and as a result of the measured drilling conditions at a particular borehole depth.

Another method of steering a drill bit is to use a deflection member. The deflection member is located close to the drill bit and has a fixed or adjustable deflection which will tend to steer the drill bit in a direction dependent upon the orientation of the deflection. The deflection member may for example be a bent housing, or it may cause the drive shaft or drill bit to deviate from the centre of the borehole being drilled. When it is desired to drill a linear (or more linear) section of borehole the deflection member is rotated so as to continuously change the orientation of the deflection and therefore to cancel out the tendency for the borehole to curve in one direction. Rotation of the deflection member may be effected by way of a downhole motor or by way of the drill string.

UK patent applications 2 435 060 and 2 440 024 both describe methods of steering a drill bit by way of a controllable deflection member, the deflection member comprising a bent housing. The bend is provided in the housing of a downhole motor which lies immediately behind the drill bit. The drill string is rotated and there is a rotatable connection between the drill string and the housing of the downhole motor. A clutch mechanism is provided within the rotatable connection, the clutch mechanism controlling the orientation of the housing and consequently the orientation of the bend.

SUMMARY OF THE INVENTION

The present invention is directed to a controllable deflection tool, i.e. to an apparatus which can control the orientation of the deflection member. As in the prior art controllable deflection members for steering a drill bit within a borehole, the deflection member can be controlled to operate in a first condition in which it rotates whereby to cancel out any tendency to deviate the borehole in a particular direction, and a second condition in which its rotation is controlled whereby to cause the borehole to deviate in a chosen direction.

The present invention provides a mechanically simple and robust apparatus which is expected to increase the applicability of downhole steering arrangements.

According to the invention there is provided a controllable deflection tool having a first end and a second end, the tool having: a conduit for a working fluid; a rotary element adapted for rotation within the tool; a deflection member; a vane motor configured to rotate the deflection member relative to the rotary element; and a valve for controlling the flow of working fluid to the vane motor.

Accordingly, by controlling the flow of fluid to the vane motor, the rotation of the deflection member relative to the rotary element can be controlled. The rotary element can be connected to the drill string for example, and can rotate with the drill string. Controlling the rotation of the deflection member relative to the rotary element thereby controls the rotation of the deflection member relative to the drill string. The deflection member can be made to rotate with the drill string, or to counter the rotation of the drill string and maintain a chosen orientation within the borehole.

It will be understood that a vane motor is a positive displacement motor, i.e. the rate of rotation is directly controlled by the rate of fluid flow through the motor. Also, a vane motor is mechanically simple and robust and can readily use drilling fluid. The inventors have therefore provided a controllable deflection tool, and can provide a downhole steering assembly, which is sufficiently mechanically simple, and is sufficiently robust, to be used in extremely harsh environments.

The method can further include the steps of In drilling applications the working fluid is preferably drilling fluid which is pumped from the surface to the drill bit connected to the second end of the controllable deflection tool. In the simplest embodiments of the invention the controllable deflection tool and the drill bit are connected to a rotatable drill string, the drill bit being driven to rotate by, and at the same rate as, the drill string. In such embodiments the rotary element can be a drive shaft for the drill bit, and the vane motor can be configured to rotate the deflection member relative to the drive shaft.

In more typical embodiments the drill string carries a downhole motor, the motor having a stator and a rotor. In typical fashion, the stator is connected to the drill string, and the rotor is connected to the drill bit. The controllable deflection tool will preferably be connected between the downhole motor and the drill bit. In such embodiments a rotatable shaft is preferably provided within the tool to communicate rotary motion from the rotor to the drill bit. It is preferred that the rotatable shaft is separate from the rotary element of the controllable deflection tool, the rotary element for example being connected to the stator and therefore being indirectly connected to the drill string. The rotary element therefore rotates with the drill string, and the vane motor is required to counter the rotation of the drill string rather than the (much faster) rotation of the rotor.

Preferably, the valve controls the flow of drilling fluid to the vane motor so that the vane motor is actuated by a quantity of drilling fluid extracted from the drilling fluid flowing along the conduit. Alternatively, the valve controls a hydraulic fluid which passes around a closed loop within the controllable deflection tool. The latter arrangement requires a pump, whereas the former arrangement can avoid the requirement for a pump by utilising the differential pressure of the drilling fluid inside and outside the controllable deflection tool.

In common with known vane motors, the vane motor of the present invention comprises an eccentric housing within which is located a body carrying a plurality of vanes, the body being rotatable relative to the eccentric housing. The vanes are movably mounted upon the body so that they remain in contact with the eccentric housing during rotation of the body.

The invention also provides a downhole steering assembly adapted for connection to a rotatable drill string, the assembly comprising a drill bit, a downhole motor and a controllable deflection tool located between the downhole motor and the drill bit, the downhole motor having a stator and a rotor, the controllable deflection assembly comprising a rotatable shaft for communicating rotary motion from the rotor to the drill bit, a conduit for the passage of working fluid to the drill bit, a vane motor configured to rotate the deflection tool relative to the stator, and a valve for controlling the flow of fluid to the vane motor.

Preferably the stator is connected to the drill string. Preferably also the stator is connected to the body of the vane motor. It is arranged that in use the rotor rotates in the same direction as the drill string, in known fashion.

When the valve is closed and fluid does not flow through the vane motor, the deflection tool rotates with the drill string and a linear (or more linear) section of borehole is drilled. When the valve is opened the vane motor can drive the deflection tool to rotate relative to the drill string in the opposed direction to the rotation of the drill string. The rate of counter-rotation of the deflection tool can be matched to the rate of rotation of the drill string so that the deflection tool maintains a constant orientation within the borehole, and the deflection tool causes the drill bit to deviate from a linear path in a chosen direction.

Ideally, the vane motor has four vanes, each of which is slidably located in a respective channel of the body. The channels are preferably all open to the conduit for working fluid, so that the pressure of the working (e.g. drilling) fluid acts to drive the vanes towards their extended positions. The vanes are therefore maintained in engagement with the eccentric housing by the pressure of the working fluid within the deflection tool.

There is also provided a method of steering a downhole drilling assembly, comprising the steps of:

{i} providing a downhole motor, a controllable deflection tool and a drill bit, and connecting the controllable deflection tool between the downhole motor and the drill bit, the controllable deflection tool comprising:

a rotatable shaft for communicating rotary motion from the downhole motor to the drill bit, a conduit for the passage of working fluid from the downhole motor to the drill bit, a vane motor configured to rotate the deflection tool relative to the drill string, and a valve for controlling the flow of fluid to the vane motor;

{ii} determining a curved path for the drill bit;

{iii} operating the valve whereby to rotate the vane motor relative to the drill string; and {iv} modulating the valve whereby to maintain a chosen orientation of the deflection tool.

Locating the vane motor between the drill bit and the downhole motor reduces the torque which the vane motor is required to provide in order to control the rotation of the deflection tool. The torque of the vane motor must overcome firstly the friction in the internal bearings and rotating componentry, and secondly the friction due to engagement with the borehole. The vane motor is not required to counter the significantly larger torque induced into the drill string by the downhole motor, as is the case with the prior art arrangements of UK patent applications 2 435 060 and 2 440 024 for example.

BRIEF DESCRIPTION OF THE PREFERRED EMBODIMENTS

The invention will now be described in more detail, by way of example, with reference to the accompanying drawings, in which.

DETAILED DESCRIPTION

Figure 1:
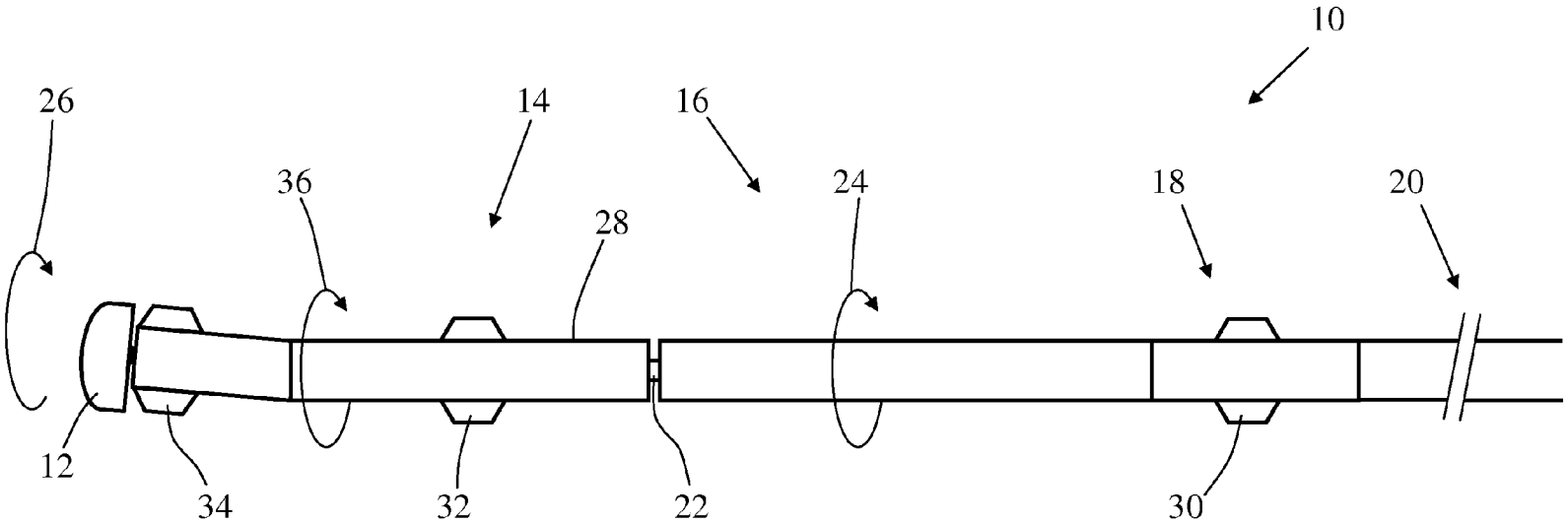
FIG. 1 represents a downhole steering assembly incorporating the controllable deflection tool according to the present invention, in the condition for drilling a linear section of borehole.
Figure 2:
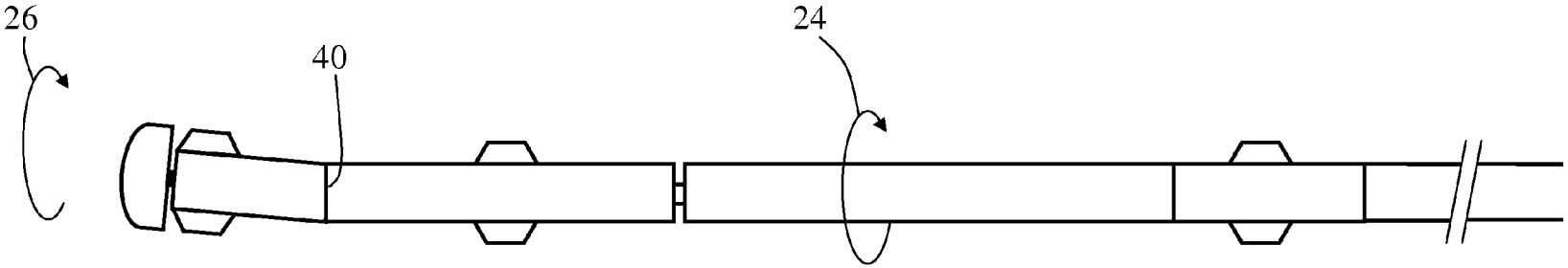
FIG. 2 is as FIG. 1 but in the condition for drilling a curved section of borehole.

The downhole steering assembly 10 of FIGS. 1 and 2 comprises a drill bit 12, a controllable deflection tool 14, a downhole motor 16, and a stabilizer 18. The assembly is connected to drill string 20 which continues to the Earth's surface.

In known fashion, a drilling fluid, often called drilling mud, is pumped down the drill string 20, and through the downhole motor 16. The controllable deflection tool 14 is configured to operate with a rotating drill string 20, the drill string being rotated by surface equipment (not shown) in known fashion. The stator (typically the housing) of the downhole motor 16 rotates with the drill string 20, as represented by the arrow 24. The downhole motor 16 is a positive displacement motor which converts the passage of drilling fluid into rotation of a rotatable shaft 22 whereby the rotatable shaft 22 rotates in the same direction as the drill string 20, but at a significantly faster rate.

The rotation of the shaft 22 is communicated to the drill bit 12 by way of the controllable deflection tool 14. The rotation of the drill bit 12, which is represented by the arrow 26, is in the same direction as, and at the same rotational rate as, the shaft 22.

The drilling fluid, having passed through the downhole motor 16, continues through the controllable deflection tool 14 and exits adjacent to the drill bit 12. The drilling fluid, and entrained drill cuttings, flow along the outside of the downhole assembly 10 and drill string 20 back to the surface, in known fashion.

The stabilizer 18 has a number of blades 30 which engage the borehole and serve to centralise the stabilizer 18. The controllable deflection tool 14 has similar sets of blades 32, 34, the latter comprising a near-bit stabilizer.

In the arrangement of FIG. 1, the controllable deflection tool 14 is driven to rotate with the drill string 20 as explained below, and is therefore rotating in the same direction as the shaft 22 and drill bit 12, albeit at a slower rate, the rotation of the controllable deflection tool 14 being represented by the arrow 36. The orientation of the deflection tool 14, and in particular the direction of the deflection member or bend 40, is therefore continuously changing, so that the downhole assembly 10 tends to drill a linear section of borehole.

In the arrangement of FIG. 2 on the other hand, the controllable deflection tool 14 is rotating relative to the drill string 20 in the opposite direction to the drill string, and at the same rate. Accordingly, the orientation of the deflection tool 14 within the borehole is substantially maintained and the downhole assembly 10 tends to drill a curved section of borehole determined by the deflection member, i.e. determined by the angle and orientation of the bend 40.

It will be understood that the present invention can therefore benefit from the reduced sliding friction and hence increased reach (and in particular increased lateral reach) of the borehole which a rotating drill string can provide. However, in alternative embodiments it could be that if desired the drill string does not rotate continuously.

In this embodiment the deflection member of the controllable deflection tool 14 comprises a bend 40, but it will be understood that an alternative deflection member could be utilised, such as an offset stabilizer or an offset drive shaft (i.e. offset from the longitudinal axis of the tool), as desired. As explained in detail below, the deflection tool 14 is directly driven by a vane motor in a contrary direction of rotation to that of the drill string 20. By precise control of the speed of contra-rotation the deflection tool 14 is caused to adopt a constant orientation with respect to the borehole. By maintaining a constant orientation whilst the bit is rotating and drilling proceeds, a curved section of borehole can be drilled and the trajectory of the borehole is changed.

Figure 3:
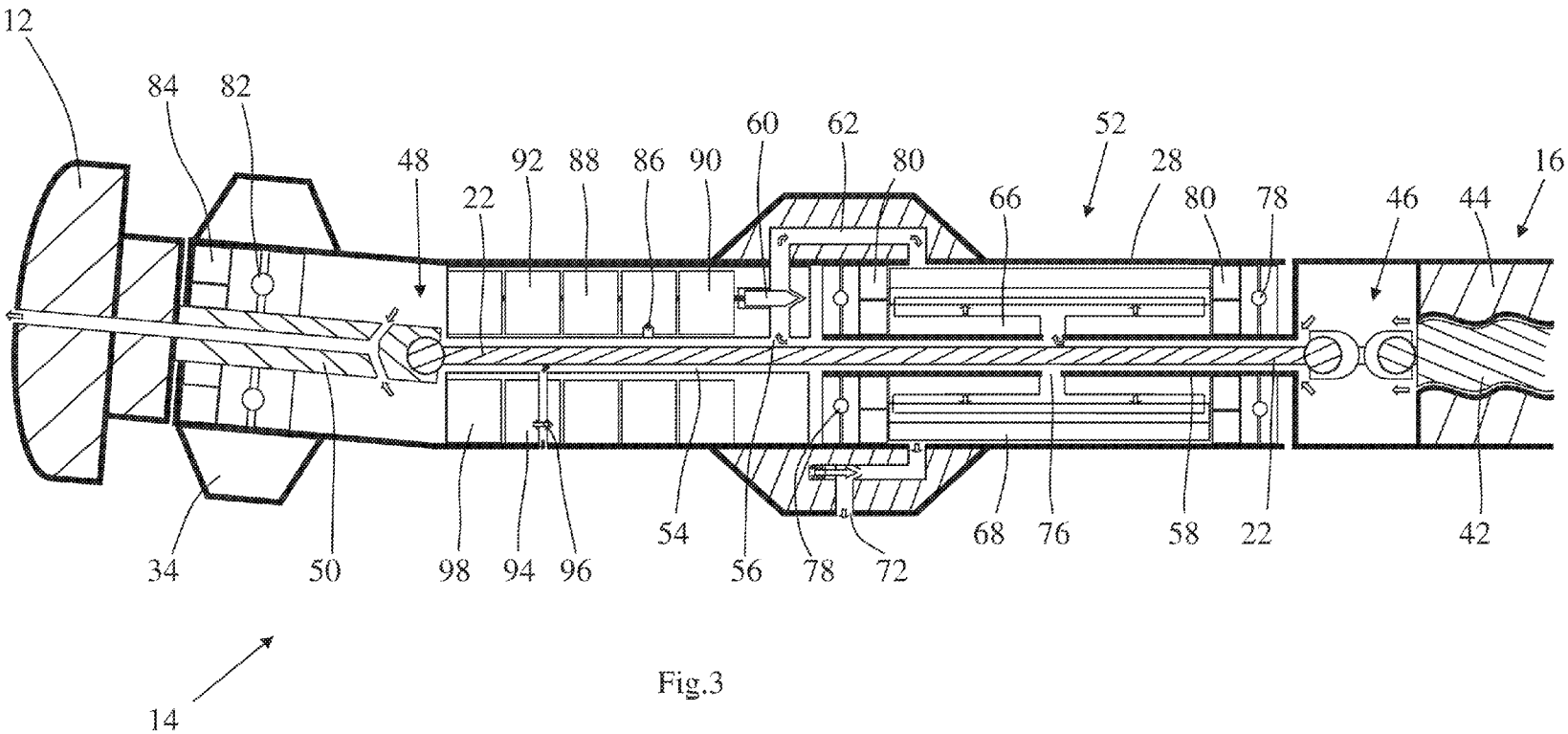
FIG. 3 is a sectional view of a part of the downhole steering assembly of FIGS. 1 and 2.

As shown in FIG. 3, the downhole motor 16 (only part of which is shown) comprises a rotor 42 and a stator 44. The stator 44 is connected to the drill string 20 and rotates with the drill string. The rotor 42 is connected to the shaft 22 by way of a constant velocity coupling 46. The shaft 22 communicates the rotation of the rotor through the controllable deflection tool 14, and is in turn connected by way of another constant velocity coupling 48 to the driveshaft 50 which is connected to the drill bit 12. The constant velocity couplings 46, 48 ensure that the drill bit 12 rotates at the same rate as the rotor 42, but permit the required pivoting movement between the respective parts of the downhole assembly 10.

In known fashion, the flow of drilling fluid through the downhole motor 16 causes the rotor 42 to rotate relative to the stator 44. As represented by the small arrows in FIG. 3, the drilling fluid flows past the constant velocity coupling 46, along a conduit 54 which surrounds the shaft 22, past the constant velocity coupling 48, along the driveshaft 50 and exits at the drill bit 12. The drilling fluid thereafter flows along the outside of the downhole assembly 10 and drill string 20 back to the surface.

The conduit 54 is defined in part by a sleeve 58 which surrounds the rotatable shaft 22. The sleeve 58 is connected to the stator 44 and rotates with the stator (and therefore with the drill string 20). The sleeve 58 comprises the rotary element in this embodiment. The sleeve 58 is not shown in FIGS. 1 and 2 for clarity, but it will be understood that in practical embodiments the shaft 22 is not visible between the downhole motor and the controllable deflection tool since it is hidden within the sleeve 58.

Figure 4:
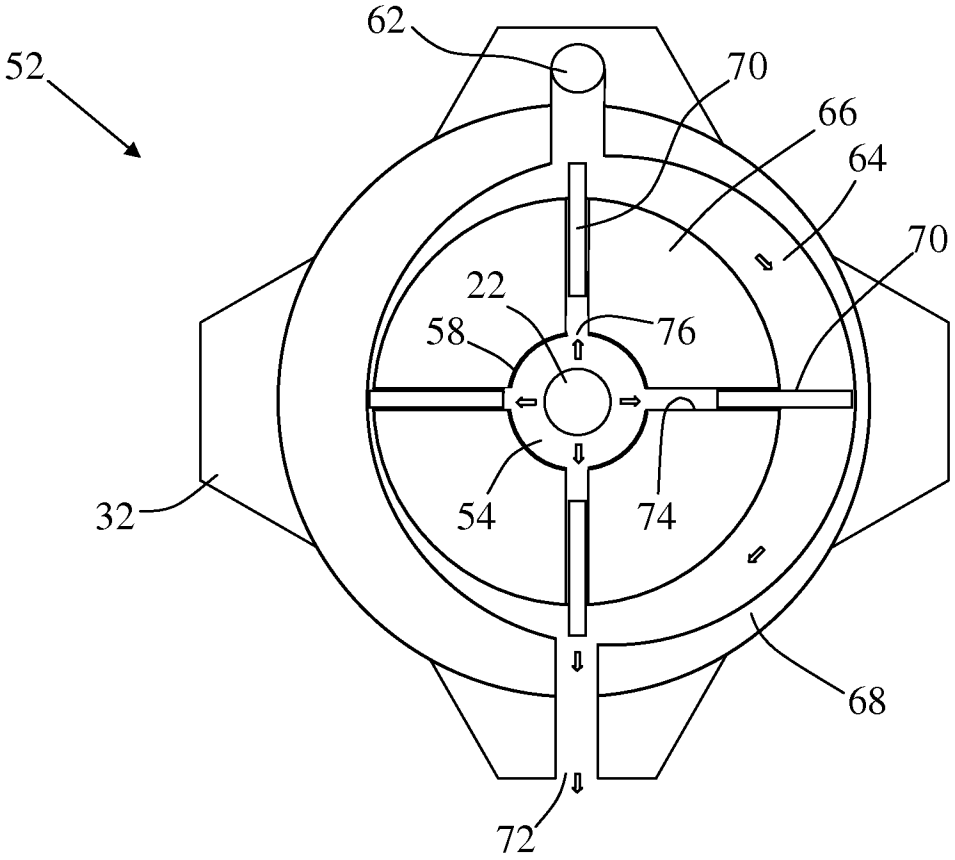
FIG. 4 is a cross-section through the vane motor of the controllable deflection tool.

The controllable deflection tool 14 includes a vane motor 52. The vane motor 52 in this embodiment is driven by the drilling fluid. A port 56 is in communication with the conduit 54, the flow of fluid through the port 56 being controlled by a valve 60. As shown in FIGS. 3 and 4, when the valve 60 is open, drilling fluid can pass along fluid conduit 62 and enter the chamber 64 between the body 66 and the eccentric housing 68.

The apparatus can be run into the wellbore in the primary configuration.

The method can include the step of automatically returning to the primary configuration after a predetermined period of time.

The drilling fluid leaves the chamber 64 through the outlet port 72 and returns to the surface with the drilling fluid which has passed the drill bit.

The body 66 is connected to the stator 44 of the downhole motor 16 by way of the rotary element or sleeve 58. The body 66 of the vane motor 52 is therefore directly driven to rotate with the stator 44 and therefore with the drill string 20.

When viewed from the uphole end as in FIG. 4, the drill string 20 and consequently the sleeve 58 and body 66, typically rotate clockwise. The vane motor 52 and thus the deflection tool 14 are therefore configured to counter the rotation of the drill string 20 by rotating the eccentric housing 68 counter-clockwise relative to the sleeve 58.

The energy required to introduce drilling fluid into the vane motor 52 is provided by the differential between the pressure within the conduit 54 of the deflection tool 14 and the pressure outside the deflection tool (i.e. between the deflection tool 14 and the borehole). This differential pressure is approximately equal to the pressure drop across the drill bit 12, and is typically several million Pascals (several hundred pounds per square inch).

The body 66 carries four vanes 70 and can rotate relative to the eccentric housing 68, the vanes remaining in contact with the eccentric housing 68 as they rotate within the eccentric housing. The vanes 70 are movable relative to the body 66, each vane 70 being slidably located within a respective channel 74. A set of ports 76 through the sleeve 58 deliver drilling fluid into each of the channels 74, the pressure of the drilling fluid acting to extend the vanes 70 into contact with the eccentric housing 68.

FIG. 4 shows a small clearance between the vanes 70 and their respective channels 74, and also between the vanes 70 and the eccentric housing 68, but that is only for the purpose of clarity and it will be understood that the vanes are in sliding and sealing contact with their channels, and in sliding and sealing contact with the eccentric housing 68.

The sleeve 58 and body 66 are supported by thrust bearings 78 and radial bearings 80 which facilitate rotation of the sleeve 58 and body 66 within the deflection tool 14 and in addition transfer drilling loads from the deflection tool 14 to the downhole motor 16. Similarly, thrust bearings 82 and radial bearings 84 transfer drilling loads from the drill bit 12 to the deflection tool 14.

When the valve 60 is closed the vane motor 52 is hydraulically locked against rotation relative to the sleeve 58. The eccentric housing 68 is driven to rotate with the body 66 and since the eccentric housing 68 is connected to the housing 28 of the controllable deflection tool 14, the housing 28 rotates at the same rate as the drill string 20. This is the situation represented in FIG. 1.

To change the trajectory of the borehole a signal (in this embodiment a coded pressure pulse within the drilling fluid) is communicated from the surface, specifying the required orientation of the deflection member or bend 40. This signal is detected by a pressure sensor 86 and decoded in the control module 88.

A control signal is communicated to the valve actuator 90, whereupon the valve 60 is gradually opened, causing drilling fluid to flow into the chamber 64 of the vane motor 52. The body 66 and vanes 70 continue to rotate with the sleeve 58 and drill string 20, and fluid flowing into the chamber 64 causes the rate of rotation of the eccentric housing 68 (and thereby the rate of rotation of the deflection tool housing 28 and the deflection member 40) to reduce.

With sufficient fluid flow through the vane motor 52, the vanes 70 and body 66 are driven by the fluid to rotate relative to the eccentric housing 68 at the same rate as they are being driven by the drill string 20 relative to the borehole, at which point the eccentric housing 68 stops rotating relative to the borehole (and similarly the tool housing 28 stops rotating relative to the borehole, with the flowing fluid effectively driving the vane motor 52 to rotate in the opposite direction to the drill string). A sensor module 92 detects that the counter-rotation of the deflection tool 14 matches the rotation of the drill string 20. The valve 60 is thereafter modulated until the required orientation of the deflection tool 14 is achieved and maintained. This is the situation represented in FIG. 2.

Confirmation of the orientation of the deflection tool 14 and measurements of the borehole trajectory are sent to the surface by way of a pulser module 94 which introduces a coded pressure signal into the drilling fluid by venting drilling fluid through a pulser valve 96.

In this embodiment electrical power for the valve actuator 90, control module 88, sensor module 92, pulser module 94 and pulser valve 96 is supplied by a battery module 98. However, in alternative embodiments an electrical generator, powered either by drilling fluid flow or from rotation of the driveshaft 50 or rotatable shaft 22, could be used instead of, or in addition to, the battery module.

If it is desired not to use the drilling fluid to power the vane motor 52, a pump (such as a separate vane pump for example) could be driven by the driveshaft 50 or shaft 22 to provide a closed loop supply of hydraulic fluid to the vane motor 52.

It will be understood that the controllable deflection tool 14 could be used with a rotating drill string without a downhole motor. In such embodiments the drill bit rotates at the same rate as the drill string and there is no requirement for a separate rotatable shaft. One such embodiment could differ from the arrangement shown in FIG. 3 by omitting the shaft 22 and continuing the rotary element or sleeve 58 through the tool 14, the sleeve being connected to the constant velocity coupling 48 and thereby to the drive shaft 50. The vane motor 52 could operate in the same way in order to rotate the tool housing 28 and deflection member 40 relative to the sleeve 58.

It will be understood that the use of pulse signals in the drilling fluid is only one means of communicating from and to the surface, and alternatively other known means of communicating with downhole tools could be used if desired.

What is claimed:

1. A controllable deflection tool having a first end and a second end, the tool having:

a conduit for a working fluid;

a rotary element configured to rotate within the tool;

a deflection member;

a vane motor configured to rotate the deflection member relative to the rotary element, the vane motor comprising an eccentric housing within which is located a body carrying at least three vanes, the body being connected to the rotary element to rotate with the rotary element, the body being rotatable relative to the eccentric housing, the vanes being movably mounted upon the body so that they remain in contact with the eccentric housing during relative rotation of the body; and a valve for controlling the flow of working fluid to the vane motor, in which the deflection member is a bent housing.

2. The controllable deflection tool according to claim 1 in which the rotary element is an annular sleeve.

3. The controllable deflection tool according to claim 2 in which the annular sleeve surrounds a part of a rotatable shaft.

4. The controllable deflection tool according to claim 3 in which there is a gap between the sleeve and the shaft, the gap providing a part of the conduit.

5. The controllable deflection tool according to claim 1 in which the vane motor has at least three channels, each channel being configured to locate a vane, the vanes being movable relative to their respective channel.

6. The controllable deflection tool according to claim 5 in which the conduit is in communication with each of the channels, the pressure of the working fluid in use acting to drive the vanes into engagement with the eccentric housing.

7. The controllable deflection tool according to claim 1 in which the valve controls the flow of working fluid from the conduit to the vane motor.

8. The controllable deflection tool according to claim 1 in which the working fluid passes around a closed hydraulic loop.

9. A downhole steering assembly adapted for connection to a rotatable drill string, the assembly comprising:

a drill bit, a downhole motor and a controllable deflection tool having:

a first end and a second end;

a conduit for a working fluid;

a rotary element configured to rotate within the tool;

a deflection member;

a positive displacement motor configured to rotate the deflection member relative to the rotary element; and a valve for controlling the flow of working fluid to the positive displacement motor, the controllable deflection tool being configured to be located between the downhole motor and the drill bit, the downhole motor having a stator and a rotor, the stator being adapted for connection to the drill string and to rotate with the drill string, the rotary element being connected to the stator to rotate with the stator, the rotor being configured to be connected to the drill bit.

10. The downhole steering assembly according to claim 9 in which the controllable deflection tool includes a rotatable shaft which communicates rotation of the rotor to the drill bit.

11. A method of steering a downhole drilling assembly comprising the steps of:

{i} connecting a downhole motor, a drill bit, and a controllable deflection tool to a rotatable drill string, the controllable deflection tool having a first end and a second end, the tool having:

a conduit for a working fluid;

a rotary element configured to rotate within the tool;

a deflection member;

a positive displacement motor configured to rotate the deflection member relative to the rotary element; and a valve for controlling the flow of working fluid to the positive displacement motor, the downhole motor having a stator and a rotor, the stator being connected to the drill string to rotate with the drill string, the controllable deflection tool being located between the downhole motor and the drill bit, the drill bit and the rotor being connected to rotate together, the rotary element being connected to the stator to rotate with the stator;

{ii} operating the drilling assembly to rotate the drill bit and drill a length of borehole;

{iii} determining a curved path for the drill bit;

{iv} operating the valve whereby to rotate the positive displacement motor relative to the drill string; and {v} modulating the valve whereby to maintain a chosen orientation of the deflection member.

* * * * *